United States Patent [19]

Fraula

[11] 3,982,552

[45] Sept. 28, 1976

[54] THERMAL PROTECTION FOR DISHWASHING MACHINE

[75] Inventor: Louis F. Fraula, Troy, Ohio

[73] Assignee: Hobart Corporation, Troy, Ohio

[22] Filed: June 26, 1975

[21] Appl. No.: 590,431

[52] U.S. Cl. ..... 134/57 D; 134/107; 134/108; 236/1 E

[51] Int. Cl.[2] ..... B08B 3/02

[58] Field of Search ..... 134/57 D, 105, 107, 134/58 D, 108; 236/1 E

[56] References Cited

UNITED STATES PATENTS

| | | | |
|---|---|---|---|
| 2,151,354 | 3/1939 | Osuch | 134/57 D X |
| 3,103,936 | 9/1963 | Nolte | 134/107 X |
| 3,104,669 | 9/1963 | Claywell | 134/107 X |
| 3,149,637 | 9/1964 | Claywell | 134/108 X |
| 3,173,432 | 3/1965 | Dronberger | 134/57 D X |
| 3,440,399 | 4/1969 | Reifenberg | 134/108 X |
| 3,527,446 | 9/1970 | White | 236/1 E X |

*Primary Examiner*—Robert L. Bleutge
*Attorney, Agent, or Firm*—Biebel, French & Nauman

[57] ABSTRACT

A dishwashing machine having a gas-fired heater is provided with a flue structure having wall portions common to the tank and wash chamber of the machine. While the machine is running liquid splashes against these wall portions and exchanges heat therewith. When the water circulation system is stopped, the heater is limited to a standby condition which is predetermined to maintain these wall portions at substantially the same temperature as during running conditions.

3 Claims, 4 Drawing Figures

THERMAL PROTECTION FOR DISHWASHING MACHINE

BACKGROUND OF THE INVENTION

This invention relates to dishwashing machines, particularly commercial machines which utilize a recirculating wash system of relatively high flow capacity, and which may incorporate some form of conveyor and/or racks to carry soiled articles through the machine. Types of machines to which the invention is applicable are disclosed in U.S. Pat. Nos. 2,073,521; 2,884,935; 3,049,391; 3,067,757; 3,254,698; 3,267,944 and 3,844,299.

These machines are manufactured with various optionally available equipment, one option being the type of heater used to maintain the desired temperature of the recirculated wash liquid. Electric immersion heaters are mountable with heating elements extending into the tank. Steam injectors can also be used to heat the wash liquid by adding steam to it. In either case, the heat is applied to the pool of liquid within the tank of the machine.

In the case of gas-fired heaters, a gas burner is mounted to the underside of the tank to heat the water by conduction through the tank walls or through an immersion tube. The flue for hot products of combustion runs along a wall of the tank and usually a wall of the washing chamber above, in fact it is a practice to use portions of these walls as parts of the flue construction. Thus these tank and chamber walls are subjected to substantial temperature increase, and care must be exercised to avoid thermal cycling of these walls and various joints they form with other structure of the machine. If the pump is turned off, as for a temporary stoppage, while the gas heater continues to run at full output, the change in liquid level in the tank and the lack of liquid splashing over the chamber walls and upper walls of the tank produces quite a different thermal gradient in the wall than under dynamic conditions with the pump running. These changing temperature conditions can lead to thermal fatigue, of these materials which results in cracking of tank walls or joints, and can require major service to the machine.

SUMMARY OF THE INVENTION

In accordance with this invention the operation of a gas-fired dishwasher heater is interconnected with the operation of the pump motor, such that if the heater is operating and the pump is shut down, the heater is adjusted to a standby rate, as by restricting its fuel supply. This limits the temperature of the aforementioned tank and chamber walls which are common to the flue. The limitations thus imposed on the gas heater are not detrimetal to its overall function, but they automatically reduce thermal stressing of the common walls to the point where thermal fatigue is essentially avoided.

In addition, the automatic adjustment of the heat rate saves a considerable amount of fuel when the dishwashing machine is in the standby mode.

Accordingly, the principal object of this invention is to provide an improved control for a gas-fired dishwasher heater which automatically reduces the heater output whenever the pump is stopped; to provide such a control in order to minimize thermal fatigue of metal walls and parts which are common to the heater flue and the tank and chamber walls of the machine; and to provide such a control which has the additional benefit of conserving fuel when the machine is in a standby condition.

Other objects and advantages of the invention will be apparent from the following description, the accompanying drawings and the appended claims.

DESCRIPTION OF THE PREFERRED EMBODIMENTS

Figure 1:
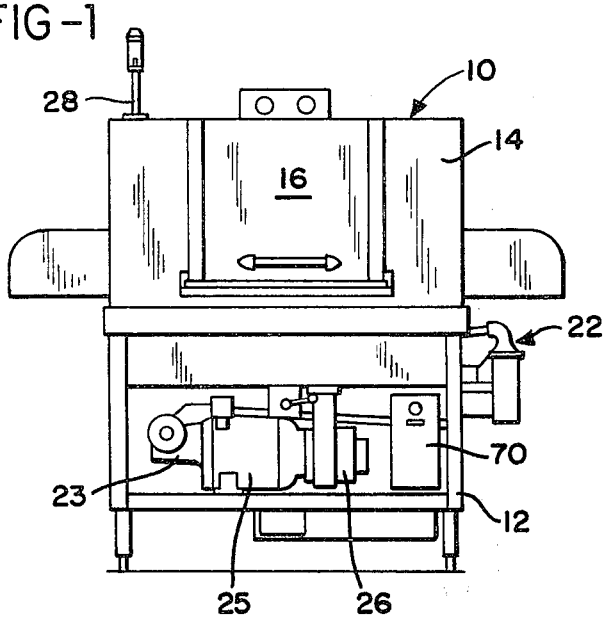
FIG. 1 is a front view of a typical dishwasher incorporating the heater control of the invention.
Figure 2:
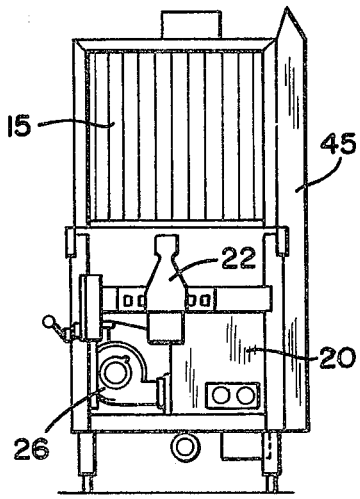
FIG. 2 is a side view of the dishwasher shown in FIG. 1.

While the invention is applicable to a number of different models of commercial dishwashing machines, the machine shown in FIG. 1 is typical, and is generally constructed in accordance with the disclosure in U.S. Pat. No. 2,073,521. The machine as shown in FIGS. 1 and 2 is set up for right to left operation, with FIG. 2 illustrating the entrance side of the machine. The machine includes a housing 10 mounted on suitable framework 12, with the upper portion or cleansing chamber 14 of the housing having entrance and exit openings which may be covered by flexible curtains. The entrance curtain 15 is shown in FIG. 2.

The chamber 14 may include a sliding door 16 which is opened for cleaning purposes, but is closed during normal operation. A tank 20 is provided in the lower portion of the frame, beneath the chamber 14, and typically a conveyor (not shown) is provided to carry racks of soiled articles through the machine. The conveyor drive crank is shown at 22, and is driven in oscillating fashion from a gear reduction unit 23 which is mounted to one end of the motor 25. At its other end the motor is connected to drive the pump 26 which functions to draw dishwashing liquid from the tank 20 and pump it through spray devices 27 which are conventionally mounted in the upper and lower portions of chamber 14.

Near the exit end of the chamber there is a final fresh water rinse spray which receives hot fresh water from the spray connection 28. As is well known, this fresh water adds to the washing liquid in tank 20, and the level in the tank is maintained by an overflow standpipe.

Figure 3:
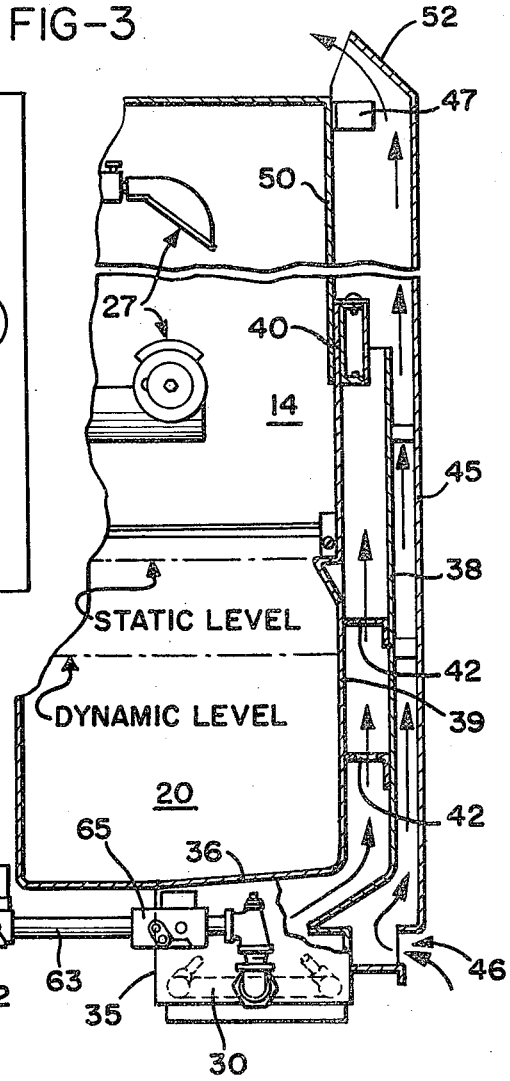
FIG. 3 is an enlarged view, broken away and predominantly in cross-section, showing the application of a gas-fired heater to the dishwasher.

FIG. 3 shows the gas-fired heater, which is constructed around the bottom and rear portions of the tank and chamber. The gas burner is shown generally at 30, having jets 32 which are directed upwardly against the bottom of the tank, and the flue structure is shown in cross-section, with arrows indicating the path of the flue gases and air. The burner housing 35 is secured to the bottom wall 36 of the tank, and the flue structure is provided by an inner sheet metal member 38 which is of elongated generally U-shaped in horizontal cross-section, having its edges fastened to the rear wall 39 of the tank extending up to at least the region of the back frame member 40. Flue member 38 preferably includes a pair of hot gas mixing baffles 42 which improve heat transfer through the tank wall to the water and are essentially horizontally extending partitions provided with a plurality of holes.

The flue member 38 is surrounded by an exterior flue piece 45 which is somewhat larger than the flue member 38, but essentially of the same configuration, defining with it a space through which air may be entrained from an opening 46 near the back of the burner. The outer flue member 45 extends upwardly past the end of member 38, beyond the frame member 40, and is fastened by bracket 47 to the back wall 50 of the chamber 14. Air and flue gases mix in the upper portion of the outer flue member 45, and exhaust from the upper end of member 45, which includes a hood-like portion 52. The hot flue gases thus pass directly across the bottom and back wall of the tank, and across the back wall of the chamber, mixing with air in the upper portion of the flue structure, and exiting at the top rear of the machine.

The gas supply pipe 60 is connected to a suitable source of fuel gas, and extends to a pressure regulator and thermostatically controlled solenoid valve 62. The outlet of that valve is connected through pipe 63 to a further solenoid actuated valve 65, which is a feature of this invention, and the outlet of valve 65 is in turn connected to the burner 30.

Figure 4:
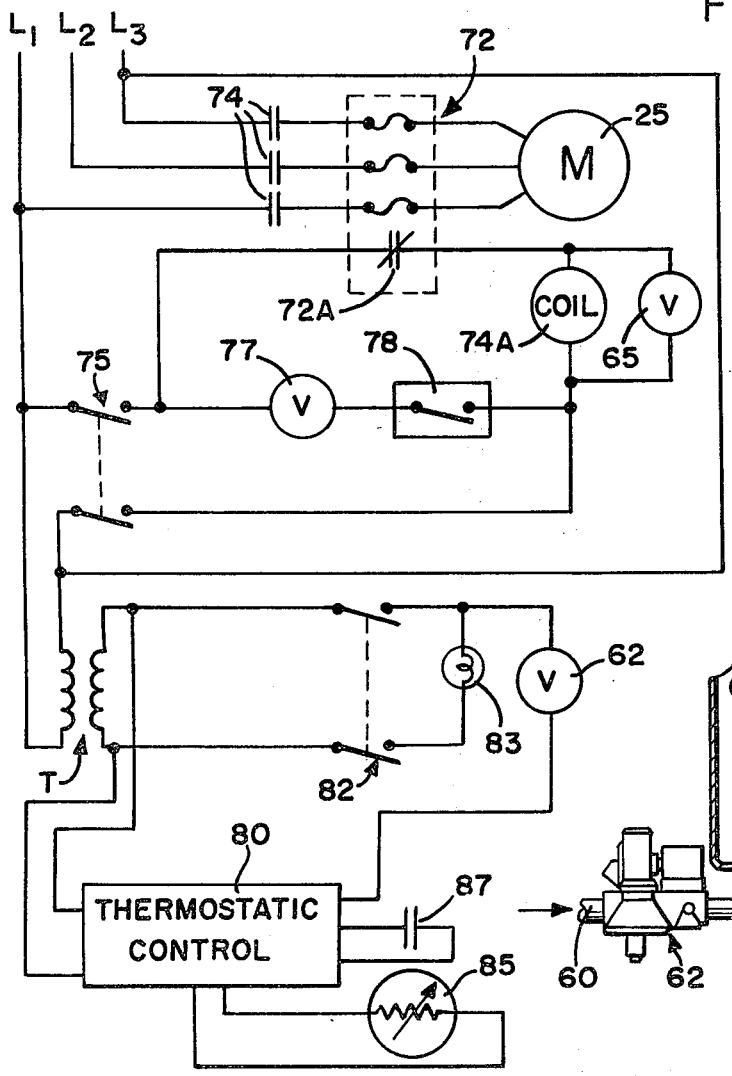
FIG. 4 is a schematic wiring diagram.

Electrical controls for the machine are housed within a water-tight box 70 (FIG. 1) and the control circuit is shown generally in FIG. 4. Motor 25 is usually a three-phase motor, shown connected to the lines L-1, L-2 and L-3 of a three-phase supply through a thermal overload protector 72 and the three contacts 74 of a motor control contactor which includes a control coil 74A.

The manually operated motor control switch 75 is shown open. When it is closed it completes a circuit through the contactor coil 74A through the normally closed contact 72A of the thermal protector. Closing of switch 75 thus starts the motor and it continues to run provided it is not over loaded so as to open contacts 72A. Both contacts of the control switch 75 are included in the power supply circuit between lines L-1 and L-3. These also control power to a solenoid operated final rinse spray valve 77 which is controlled by a micro switch 78 placed to be closed by racks of articles moving toward the exit of the chamber 14. Closing switch 78 energizes valve 77 to supply the fresh water final rinse spray from connection 28, as is well-known in the art. The solenoid of gas valve 65 is also connected and parallel with the coil of the motor controlled contactor, so that this valve is energized only when the motor is running. With the solenoid energized, valve 65 is open to permit full flow of gas from the thermostatically controlled valve 62 to the burner. When not energized, valve 65 presents a restricting orifice in the gas supply circuit to the burner, as is explained hereafter.

Lines L-1 and L-3 also supply power to the primary winding to a transformer T, and the secondary winding of the transformer supplies power to a conventional thermostatic control device 30. When the manual heater switch 82 is closed, power is also supplied to an indicator lamp 83 and through the coil of gas valve 62, under the influence of the thermostatic control 80. The control also includes a temperature sensor 85, which is placed to sense the temperature of liquid in the tank, and the contacts 87 of a low level control switch which shuts off the heater if liquid level in the tank is not at a predetermined minimum.

In starting up the machine, the operator, as part of the starting procedure, closed switches 75 and 82. With valve 65 open, and the thermostatic control calling for heat, the control valve 62 is opened, and the burner operates at high heat to bring the liquid in the tank up to operating temperature.

As the machine is operated, the level of liquid in the tank may fall somewhat due to the continuning operation of the pump and the circulation of the liquid through the spray system. This is referred to as the dynamic water level. At this time liquid is being sprayed over articles passing through the machine, against the chamber walls including back wall 50, and the upper exposed portion of tank wall 39 above the dynamic liquid level. This liquid carries away a substantial amount of the heat transmitted to these walls by the hot flue gases. In a typical unit of this type, gas flow at full heat will be sufficient to provide a heater output in the order of 80,000 BTU. The cooling action of the water splashing on the wall portions which are common to the flue structure and to the chamber and tank is sufficient to reduce the flue gas temperature by as much as several hundred degrees Farenheit. Thus, is operation the cooling action of this liquid serves to continue to absorb heat from the wall and prevent these wall portions from attaining to high a temperature.

However, when the operator stops the machine for any reason, by opening switch 75, this flow of liquid ceases. This may happen when there is a reduced supply of soiled articles to the machine or whenever the operator chooses to rest for a few minutes and turns off the pump while maintaining the water temperature.

In accordance with the invention, whenever the operator shuts down the pump motor, valve 65 is deenergized, and it effectively throttles the flow of gas to the burner, reducing this flow to a standby rate which may be in the order of one-half or less of the normal ful heating range. This is sufficient to keep the static washing liquid at the desired temperature so that the machine continues to be ready for operation, but the heater output is substantially reduced and the temperature of the common wall portions is held to approximately the same temperature as when the pump is operating and the heater is on full. As a result, there is little difference in the temperature of the common wall portions during the operating and stand-by conditions. Thermal stress of all these metal parts is substantially reduced, to the point where thermal fatigue failure is essentially eliminated. At the same time, economy of operation, and a saving of energy, is achieved by this automatic reduction in heater output when the machine is temporarily not in use.

While the form of apparatus herein described constitutes a preferred embodiment of this invention, it is to be understood that the invention is not limited to this precise form of apparatus, and that changes may be made therein without departing from the scope of the invention.

What is claimed is:

1. In a dishwashing machine having a housing defining a washing chamber including a tank for holding a quantity of washing liquid, means for supporting soiled articles in said chamber above said tank, a spray device for expelling the liquid over the articles, a motor driven pump connected to force the liquid from said tank through said spray device to cleanse the articles and to carry soil from the articles with liquid falling back into said tank, a control circuit connected for selective operation of said motor driven pump, a gas-fired heater arranged in direct heat exchange with said tank to heat the washing liquid, a flue extending from said heater upwardly along said tank and chamber, said flue, tank and chamber having common wall portions in heat exchange relation with flue gases on one side and washing liquid on the inner side of said chamber, the upper parts of said common wall portions being wetted by the liquid when said pump is in operation;

the improvement comprising gas flow control means incorporated in said gas supply and operative to meter gas flow between at least a higher normal heating rate and a substantially lower standby rate, and said control circuit having a connection to control said gas flow control means operative to reduce the gas supply automatically to the standby rate at the same time said pump is not operated by said control circuit.

2.

A commercial dishwashing machine having a washing chamber located over a tank for washing liquid and a pumping system for recirculating liquid from the tank through the chamber over soiled articles therein and back to the tank, a gas fired heater having wall portions in common with said chamber and tank, some of the liquid splashing onto said wall portions and exchanging heat therewith, and a control for said pumping system and said heater;

the improvement comprising a valve controlling gas flow to said heater, said valve in one position operating to limit the amount of gas to said heater, said control incorporating said valve to actuate it automatically to a fully open position only when said pumping system is operated by said control, and said valve in said one position limiting the heat output of said heater to maintain the temperature of said common wall portions approximately the same as when said pumping system is operating and said heater is at full output.

3. In a dishwasher having a wash chamber, a water-recirculating spray system, a metal-walled water tank below said chamber, a recirculating pump having an inlet connected to said tank and an outlet connected to said spray system, a gas flame heater associated with said tank for heating water contained therein, a gas supply line connecting said gas heater to a source of combustible gas, valve means in said supply line, an upwardly directed flue communicating with and capturing heater exhaust gases, one side of said flue comprising with portions of said wash chamber and portions of the tank a common heat-exchanging metal wall, and a pump motor and controls therefor, the physical relationship of the spray system in said chamber to the common heat-exchanging wall being such that at least a portion of the water dispersed by said spray system during operation of said pump splashes onto said wall for increasing water temperature while simultaneously cooling the said common wall and the gases rising in said flue, the improvement comprising:

said valve means including means for selectively providing volumetric gas flow of two different quantities to said heater to produce either of two substantially different heat rate levels, means including a temperature sensor in said tank for maintaining water in said tank within a predetermined temperature range, said means being operative to disconnect gas supply through said valve means upon reaching the upper limit of said range and to maintain said valve means open whenever said dishwasher is in operation and the water temperature is within the limits of said range, and means indicative of water impingement on said common wall, said means controlling said valve means to provide a heat rate within said range while spraying is taking place and to provide automatically a standby heat rate in response to spraying being discontinued.

* * * * *